United States Patent [19]

Robbins

[11] 4,403,478

[45] Sep. 13, 1983

[54] EXPANDER STROKE DELAY MECHANISM FOR SPLIT STIRLING CRYOGENIC COOLER

[75] Inventor: Roland W. Robbins, Ridgecrest, Calif.

[73] Assignee: The United States of America as represented by the Secretary of the Navy, Washington, D.C.

[21] Appl. No.: 362,355

[22] Filed: Mar. 26, 1982

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 2,047,053 | 7/1936 | Berry | 62/136 |
| 2,715,317 | 8/1955 | Rhodes | 62/3 |
| 3,233,426 | 7/1964 | Cowans | 62/403 |
| 3,577,880 | 5/1971 | Leslie | 62/86 |
| 3,896,632 | 7/1975 | Huntley | 62/88 |
| 3,906,739 | 9/1975 | Raimondi | 62/6 |
| 3,913,339 | 10/1975 | Berry | 62/6 |
| 3,914,958 | 10/1975 | Nelson | 62/403 |
| 3,967,466 | 7/1976 | Edwards | 62/402 |
| 3,999,402 | 12/1976 | Nelson | 62/403 |
| 4,175,397 | 11/1979 | Edwards et al. | 62/149 |
| 4,206,609 | 6/1980 | Durenec | 62/6 |

*Primary Examiner*—Ronald C. Capossela

*Attorney, Agent, or Firm*—R. F. Beers; W. Thom Skeer; W. D. English

[57] ABSTRACT

This invention comprises a cryogenic cooling device operating in the manner of a split Stirling cycle engine whereby a sinusoidal pressure-wave generator distal to a regenerator displacer piston and accompanying cylinder, individually compresses in a delayed manner and expands a contained volume of gas in an expander housing respective to regenerator displacer piston travel to bring about a cooling effect in an attached displacer housing.

38 Claims, 1 Drawing Figure

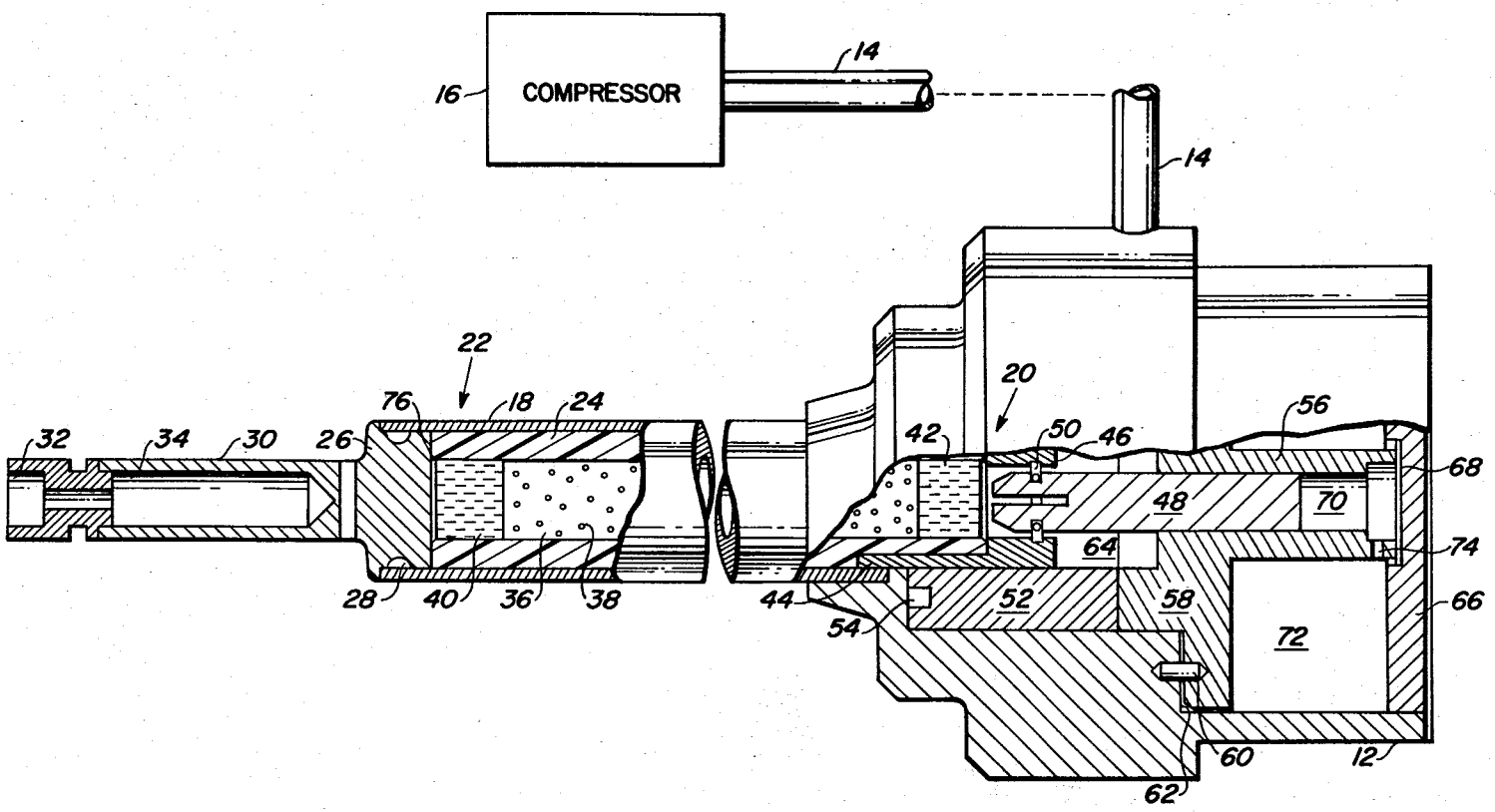
COMPRESSOR
12
14
14
16
18
20
22
24
26
28
30
32
34
36
38
40
42
44
46
48
50
52
54
56
58
60
62
64
66
68
70
72
74
76

EXPANDER STROKE DELAY MECHANISM FOR SPLIT STIRLING CRYOGENIC COOLER

BACKGROUND OF THE INVENTION

1. Field of the Invention

This invention pertains to the field of mechanics. More particularly, this invention pertains to engines that utilize gas expansion as their means of doing work. More specifically, this invention involves the application of a Stirling cycle type engine as an exemplary embodiment, but without limitation thereto. More exactly, this invention relates to a split Stirling cycle engine wherein the regenerator displacer piston and accompanying cylinder housing are distal to the compressor piston and its accompanying cylinder housing, gas volumes in each separate housing being interconnected by a hollow tube.

Mechanical work is exerted upon the engine to alternatively compress and expand a contained volume of gas. The gas contained within the engine has an ambient pressure of approximately 800 psi and is increased 20 times per second to approximately 1500 psi by a compressor piston-cylinder assembly, and is then decreased to approximately 100 psi in a sine wave fashion. The regenerator displacer piston moves from one end of its cylinder to the other end in a delayed fashion with respect to the increasing and decreasing gas pressure such that the compression gas is at its peak pressuure when the gas is at one end of the gas permeable displacer, at which point heat of compression is allowed to be rejected thereby cooling the compressed gas. Correspondingly, when the gas is expanding to its lowest pressure, the gas is at the opposite end of the gas permeable displacer, at which point heat is absorbed by the expanding gas from the surrounding environment.

Such rapidly repeated compression-expansion cycles bring about cryogenic temperatures at the expanding (cold) end of the displacer cylinder in a very short period of time.

2. Description of the Prior Art

In cooling devices of similar operation in the prior art, it was common to provide an elastic membrane or sliding flexible boot (frictional seal) to both seal the gas within the expander assembly and to delay the motion of the gas permeable regenerator displacer piston. By such means, heat build-up from the compression cycle is allowed time for rejection away from the expander assembly and during the expanding cycle, time is allowed for the expanding gas to absorb heat from the surrounding environment, thus creating a refrigerating effect upon completion of several compression expansion cycles in rapid succession.

Although satisfactory for the intended purposes, these flexible seals required careful fitting, had inherent variable drag characteristics, had limited life (mechanical failure), tended to contaminate other components, and made difficult mass production manufacturing of the expander assembly.

SUMMARY OF THE INVENTION

This invention conceives a split Stirling engine concept functioning as a cryogenic cooling system. A compressor piston assembly conveniently located distal to a regenerator displacer piston assembly, cyclically increases and decreases pressure in a sine wave fashion on a contained volume of gas in an expander housing.

An elongated, gas porous, regenerator displacer piston reciprocates in a displacer cylinder attached to the expander housing in response to the varying gas pressure but with a phased 90° delay.

This delay is required (built-in) to allow time for gas heat of compression to be rejected away from the compression end (hot end) of the expander housing during the compression stroke of the compressor piston and to allow time for heat to be drawn from the environment at the expansion end (cold end) of the displacer cylinder when the gas expands during the low pressure stage.

The delay was effected in the prior art by a friction seal sliding over the reciprocating regenerator displacer piston. The delay in this improvement is caused by utilizing two metal-to-metal seals to create three contained volumes of gas. The first seal surrounds the regenerator displacer piston and contains gas in the expander housing. The second seal surrounds a cylindrical plunger extension from the regenerator displacer piston, segregating the first volume of gas, and has a cylindrical extension that creates a second and third volume of gas.

The cylindrical extension contains an orifice of such measured dimension that gas flowing between the second and third volumes is permitted, but at a controlled rate, thus creating a resistance to the plunger piston motion, hence, a delayed stroke of the plunger and consequent delayed stroke of the attached regenerator displacer piston.

The system functions as follows: as the gas pressure in the first volume exceeds the ambient pressure of the expander housing the plunger is pushed into the second volume. Second volume gas flows through the orifice into the third volume at a controlled rate thus creating a delay in the plunger stroke.

The compressed gas in the first volume gives up heat of compression through conventional means in the high heat conductivity expander housing, and is then pushed through the porous regenerator displacer piston giving up more heat as it travels through a plurality of high heat conductivity balls in the core of the regenerator displacer piston.

As the regenerator displacer piston reaches its fullest extent of travel from the high pressure cycle, all the gas has been pushed to the distal end (cold end) of the regenerator displacer piston cylinder. Now the low pressure cooling cycle begins. When the first volume pressure of the expander housing becomes less than the ambient volume pressure the gas contained within the cold end undergoes a further reduction in temperature due to the expansion process. The low gas pressure in the first volume then causes the plunger to be pushed from the second volume back into the first volume, again at a controlled delayed rate due to the measured orifice connecting the second and third volumes.

The regenerator displacer piston moves back into its cylinder in like manner forcing the expanding gas, due to lower pressure, back through the regenerator displacer piston, the gas cooling the regenerator matrix as it travels its length and thus becoming warmer as it approaches the hot end of the expander housing.

The cycle then repeats successively until cryogenic temperatures are obtained.

BRIEF DESCRIPTION OF THE DRAWINGS

These and other objectives, features and advantages of this invention will become apparent upon reading the following detailed description of the preferred embodiments and referring to the accompanying drawings in which:

The FIGURE illustrates a longitudinal cross section of the expander assembly wherein the regenerator displacer piston 24 and displacer housing 18 are shortened in the drawing for convenience of illustration. Regenerator displacer piston 24 and displacer housing 18 are actually roughly three times the length of expander housing 12.

DESCRIPTION OF THE PREFERRED EMBODIMENT

Referring to the FIGURE there is illustrated a cylindrical expander housing 12, made of a strong and high heat conductivity material such as hardened stainless steel having a gas inlet tube 14 permanently bonded by conventional brazing means to said expander housing. The present expander housing model utilizes machined stainless steel; however, any high heat conductivity material could be used such as brass or aluminum.

A piston cylinder compressor assembly 16, conveniently located distal from expander housing 12 cyclically compresses and expands a contained volume of gas in expander housing 12 via gas inlet tube 14.

An elongated displacer housing 18 made of strong low conductivity material such as a nickel alloy is permanently bonded by conventional brazing means to one end of expander housing 12. Displacer housing 18 is low in heat cnductivity and lengthy in relation to expander housing 12 to permit a hot end 20 to develop at the junction of expander housing 12 with displacer housing 18, yet concomitantly allow a cold end 22 to develop at the distal end of displacer housing 18.

Displacer housing 18 terminates at its cold end 22 with a cylindrical plug 26 circumventually bonded to displacer housing 18 by conventional bronze brazing 28, and having a cylindrical probe 30 extending therefrom.

Probe 30 is made of high heat conductivity material such as copper in the present design, and has an open end 32 admitting a cryogen fluid (e.g. liquid air) into the hollow interior 34 for purposes of cooling the surrounding environment.

Reciprocating within displacer housing 18, is an elongated cylindrical regenerator displacer piston 24 made of strong, low heat conductivity material such as fiber glass reinforced epoxy.

Regenerator displacer piston 24 has a hollow interior 36 filled with a gas permeable granular substance 38 which comprises a heat regenerator. A plurality of nickel balls is used in the present model. A gas porous outer plug 40 is bonded to the cold end of regenerator displacer piston 24 and a similar inner plug 42 is bonded to the hot end of regenerator displacer piston 24. The present model utilizes sintered bronze but any strong, gas porous material would suffice.

A cylindrical inner element clearance seal 44 is permanently seated over the hot end 20 of regenerator displacer piston 24 with opening 46 for insertion therein of a cylindrical plunger 48. Wire retaining elements 50 operate as a universal joint for movably locking plunger 48 to inner element clearance seal 44. Inner element clearance seal 44 and plunger 48 again are made of stainless steel, but could likewise be made of any material suitable for sustaining sliding contact with the other element of the clearance seal. The clearance seals rub against each other and therefore resistance to abrasion and galling is of prime importance. High heat conductivity is nice but secondary.

A cylindrical outer element clearance seal 52 movably fits over inner element clearance seal 44 with a closely matched tolerance such that gaseous flow therethrough is limited if not eliminated. Outer element clearance seal 52 again is made of hardened stainless steel, but can forseeably be any suitable material.

Outer element clearance seal 52 is sealed to expander housing 12 by any conventional means, herein described at 54 as a circular Indium seal, to prevent any leak in gas out of expander housing 12.

A cylindrical plunger clearance seal 56 slidably fits with a close tolerance over plunger 48 such that gas flow therethrough is limited if not eliminated. Flange 58 extends outwardly from one end of seal 56, contains a positioning pin 60, and is sealed to expander housing 12 by a circular static seal 62 of any conventional type (in the present model a copper seal is utilized), to enclose a first volume of gas 64.

End cap 66 seals off expander housing 12 and plunger clearance seal 56 with a copper cylindrical seal 68 thereby creating a second contained volume of gas 70, and a third contained volume of gas 72. Sealing is conducted by any conventional means though a copper seal is the preferred means in this embodiment.

A small orifice 74 of a predetermined diameter extends through plunger clearance seal 56 interconnecting second gas volume 70 and third gas volume 72 such that gas flow between the two volumes can be regulated and delayed.

The system functions as follows:

With regenerator displacer piston 24 fully traveled to the left as shown in the FIGURE, gas is pumped into the first gas volume 64 through gas inlet tube 14 increasing the pressure therein.

As the pressure in volume 64 increases to approximately 700 psi over the ambient 800 psi for volumes 64, 70, and 72, plunger 48 is forced out of volume 64 into volume 70 pulling along regenerator displacer piston 24.

Gas in volume 70 being compressed by plunger 48 now exceeds pressure of gas in volume 72 resulting in a flow through orifice 74. The flow, however, is retarded due to the small diameter of orifice 74 such that a 90° phase delayed movement of plunger 48 and attached regenerator displacer piston 24 is incurred, respects compressor piston movement contained within piston-cylinder compressor assembly 16.

As regenerator displacer piston 24 moves into volume 64 the compressed gas is forced through gas porous inner plug 42, through granular substance 38 and through gas porous outer plug 40 giving up heat of compression as it travels. Much of the heat is given up in the high heat conductive expander housing 12.

When plunger 48 and regenerator displacer piston 24 reach their fullest extent of travel to the right in FIG. 1, most of the gas of volume 70 is in volume 72 and most of the compressed gas in volume 64 is in new volume 76, a fourth volume of gas at the distal end of displacer housing 18.

Now the gas pressure through displacer housing 18 begins to drop due to decreased pressure from compressor 16. As the pressure in volume 64 decreases to approximately 700 psi under the ambient 800 psi for volumes 64, 70, and 72, plunger 48 is forced out of volume 70 into volume 64 pushing along regenerator displacer piston 24. Gas flow from volume 72 into volume 70 is again retarded and regulated by orifice 74 again causing a 90° phase delay in gas pressure versus displacement.

The cooled compressed gas in volume 76 is now forced back through outer plug 40 through granular substance 38, through inner plug 42 and into volume 64. As the gas so flows it experiences the diminished pressure in the system and so expands along the way, taking up heat from the surrounding environment as it travels and expands and thereby creating a cooling effect therein with the completion of one cycle.

A rapid repetition of such cycles creates a substantial reduction in temperature in probe 30 yielding cryogenic temperature levels in a short time.

Within the spirit of the invention various embodiments and details of the gas compressing expanding mechanism to create a cooling effect may be utilized in addition to those above described. The extent of the invention will more clearly be delineated in the accompanying claims.

What is claimed is:

1. A split Stirling cycle engine refrigerating device, comprising:

an expander housing having a first second, and third compartment, each retaining a contained volume of gas, a gas inlet to vary the pressure on said first compartment, and an elongated displacer housing extending from said first compartment for gas expansion and contraction as gas pressure varies therein;

an elongated regenerator displacer piston slidably situated within said displacer housing, extending into said expander housing for reciprocating movement therein;

a first seal between said expander housing and said displacer to seal gas within said housing while said regenerator displacer piston reciprocates therein;

a second seal within said expander housing to separate said first compartment from said second compartment;

a plunger attached to said elongated regenerator displacer piston, extending through said second seal to reciprocate therethrough as gas pressure varies in said first compartment; and a cylindrical extension of said second seal, surrounding said plunger to separate said third compartment from said second compartment, having an orifice through the wall thereof to connect said second and third compartments.

2. A split Stirling cycle engine according to claim 1, wherein said expanner housing and said displacer housing are cylindrical in form.

3. A split Stirling cycle engine according to claim 1, wherein said displacer housing is somewhat smaller in diameter than said expander housing.

4. A split Stirling cycle engine according to claim 1, wherein said expander housing is made of a material of substantial strength for long life and capable of holding a compressed gas at high pressure while concomitantly having a high coefficient of heat conduction for rapid conduction of heat therethrough.

5. A split Stirling cycle engine according to claim 4 wherein said expander housing material is machined stainless steel.

6. A split Stirling cycle engine according to claim 1, wherein said varying gas pressure varies sinusoidally in time and at approximately 90° phase difference with said reciprocating displacement of said regenerator displacer piston.

7. A split Stirling cycle engine according to claim 1, wherein the cylinder wall of said elongated displacer housing is thin relative to the cylinder wall of said expander housing.

8. A split Stirling cycle engine according to claim 7, wherein said displacer housing is made of a material of relatively low thermal conductivity for low heat conduction therethrough.

9. A split Stirling cycle engine according to claim 8, wherein said displacer housing is made of a nickel alloy.

10. A split Stirling cycle engine accoridng to claim 1, wherein said elongated displacer housing is sealed, at the end distal to said expander housing, with a probe extension therefrom.

11. A split Stirling cycle engine according to claim 10, wherein said probe is a hollow cylinder in form, having a diameter of somewhat smaller dimension than said displacer housing, and having an open end distal to said displacer housing.

12. A split Stirling cycle engine according to claim 11 wherein said probe is made of a material of relatively high thermal conductivity for rapid heat conduction therethrough.

13. A split Stirling cycle engine according to claim 12 wherein said material is copper.

14. A split Stirling cycle engine according to claim 10 wherein said sealant is a bronze ring between said probe extension and said displacer housing.

15. A split Stirling cycle engine according to claim 1, wherein said elongated regenerator displacer piston is a hollow cylinder made of a strong material of relatively low thermal conductivity for limited heat conduction therethrough.

16. A split Stirling cycle engine according to claim 15, wherein said material is fiber glass reinforced epoxy.

17. A split Stirling cycle engine according to claim 15, wherein said hollow cylinder is filled with a gas permeable substance.

18. A split Stirling cycle engine according to claim 17, wherein said gas permeable substance comprises a plurality of nickel balls.

19. A split Stirling cycle engine according to claim 1, wherein said elongated regenerator displacer piston is sealed at said probe end by a first gas porous plug.

20. A split Stirling cycle engine according to claim 1, wherein said elongated regenerator displacer piston is sealed at said expander housing end by a second gas porous plug.

21. A split Stirling cycle engine according to claims 19 and 20, wherein said plugs are made of a material of relatively high thermal conductivity for rapid heat conduction.

22. A split Stirling cycle engine according to claim 21, wherein said material comprises sintered bronze.

23. A split Stirling cycle engine according to claim 1, wherein said elongated regenerator displacer piston is capped at said expander housing end by a hard material.

24. A split Stirling cycle engine according to claim 23, wherein said material is ceramic.

25. A split Stirling cycle engine according to claim 1, wherein said first seal is cylindrical in form slidably surrounding said displacer cap and forming a sliding gas tight seal.

26. A split Stirling cycle engine according to claim 25 wherein said first seal is made of a strong, durable material having a relatively high thermal conductivity creating a sliding metal-to-metal seal between said expander housing and said displacer cap.

27. A split Stirling cycle engine according to claim 26, wherein said material is hardened stainless steel.

28. A split Stirling cycle engine according to claim 1, wherein said first seal is sealed to said expander housing.

29. A split Stirling cycle engine according to claim 28, wherein said seal comprises a ring of Indium between said first seal and said expander housing.

30. A split Stirling cycle engine according to claim 1, wherein said second seal is cylindrical in form having a circular flange extending from said cylinder outer surface to intersect the inner cylinder wall of said expander housing.

31. A split Stirling cycle engine according to claim 30, wherein said second seal cylinder is made of a strong, durable material having a relatively high thermal conductivity for rapid heat conduction.

32. A split Stirling cycle enging according to claim 31, wherein said material is hardened stainless steel.

33. A split Stirling cycle engine according to claim 30, wherein said flange is sealed to said expander housing.

34. A split Stirling cycle engine according to claim 33, wherein said bond comprises a circular copper ring between said flange and said expander housing.

35. A split Stirling cycle engine according to claim 30, wherein said cylindrical seal has an orifice of small dimension through the wall thereof for regulated flow of gas from compartment three to compartment two.

36. A split Stirling cycle engine according to claim 1, wherein said plunger is a solid cylinder in form.

37. A split Stirling cycle engine according to claim 36, wherein said plunger is made of a hard material having the ability to be highly polished and abrasion resistant.

38. A split Stirling cycle engine according to claim 37, wherein said material comprises hardened stainless steel, to create a sliding, gas tight, metal-to-metal seal between said plunger and said second seal.

* * * * *

UNITED STATES PATENT AND TRADEMARK OFFICE

CERTIFICATE OF CORRECTION

PATENT NO. : 4,403,478
DATED : Sep. 13, 1983
INVENTOR(S) : Roland W. Robbins

It is certified that error appears in the above-identified patent and that said Letters Patent are hereby corrected as shown below:

Column 2, line 66, change "These and other" to --Other--.
Column 3, line 54, between "bronze" and "but", insert --for plugs 40 and 42--.
Column 3, lines 64 and 65, change "the other element of the clearance seal" to --an outer element, clearance seal 52--.
Column 3, lines 65 and 66, change "The clearance seals rub against each other and therefore" to --Since clearance seals 44 and 52 rub against each other,--.
Column 4, line 1, change "A cylindrical" to --Cylindrical--.

In the abstract on the title page

Line 3, between "generator" and "distal", insert a comma --, --.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*